US010081488B2

(12) United States Patent
Weng et al.

(10) Patent No.: US 10,081,488 B2
(45) Date of Patent: Sep. 25, 2018

(54) AUTOMATIC AERATION DEVICE FOR OIL TANK

(71) Applicant: Full Most Co., Ltd., New Taipei (TW)

(72) Inventors: Ming-Chun Weng, New Taipei (TW); Ming-Tsang Yu, New Taipei (TW); Wen-Pin Pen, New Taipei (TW)

(73) Assignee: Full Most Co., Ltd., New Taipei (TW)

( * ) Notice: Subject to any disclaimer, the term of this patent is extended or adjusted under 35 U.S.C. 154(b) by 16 days.

(21) Appl. No.: 15/484,353

(22) Filed: Apr. 11, 2017

(65) Prior Publication Data

US 2017/0297815 A1 Oct. 19, 2017

(30) Foreign Application Priority Data

Apr. 14, 2016 (TW) ..... 105205275 U

(51) Int. Cl.
*B65D 90/34* (2006.01)
*B65D 88/40* (2006.01)
*B65D 88/42* (2006.01)

(52) U.S. Cl.
CPC ..... *B65D 90/34* (2013.01); *B65D 88/40* (2013.01); *B65D 88/42* (2013.01); *Y10T 137/3099* (2015.04); *Y10T 137/778* (2015.04); *Y10T 137/7772* (2015.04); *Y10T 137/86292* (2015.04)

(58) Field of Classification Search
CPC ..... Y10T 137/863; Y10T 137/86292; Y10T 137/3099; Y10T 137/7771; Y10T 137/7772; Y10T 137/778; B65D 90/34; B65D 88/42; B65D 88/40
See application file for complete search history.

(56) References Cited

U.S. PATENT DOCUMENTS 2,016,278 A * 10/1935 Ehlers ..... F16K 17/36 137/38
2,050,686 A * 8/1936 Wiggins ..... F17B 1/08 220/216
3,862,701 A * 1/1975 Strunc ..... B65D 88/34 137/587
4,342,329 A * 8/1982 Roff ..... F16K 17/196 137/202
4,768,675 A * 9/1988 Coleman ..... B65D 90/34 220/203.24
5,005,724 A * 4/1991 Imhof ..... B65D 88/42 220/216

(Continued)

*Primary Examiner* — R. K. Arundale
*Assistant Examiner* — Patrick Williams
(74) *Attorney, Agent, or Firm* — Alan D. Kamrath; Kamrath IP Lawfirm, P.A.

(57) ABSTRACT

An automatic aeration device includes a first floating roof, a second floating roof and a movable valve. The first floating roof has a through hole and a first enclosure. The second floating roof is disposed in the through hole and has a second enclosure. The movable valve is disposed above the first floating roof and the second floating roof and has a plate which has an outer wall and an inner wall. The outer wall is mounted in the first enclosure and has a plurality of first vent holes. The inner wall is mounted in the second enclosure and has a plurality of second vent holes. The automatic aeration device further includes a plurality of balls mounted between the first enclosure and the outer wall, and mounted between the second enclosure and the inner wall.

4 Claims, 7 Drawing Sheets

(56) References Cited

U.S. PATENT DOCUMENTS

| | | | | | |
|---|---|---|---|---|---|
| 5,165,445 | A * | 11/1992 | Vertanen | F16K 17/196 | 137/493.6 |
| 5,292,492 | A * | 3/1994 | Buchanan | B01D 53/508 | 423/222 |
| 6,286,438 | B1 * | 9/2001 | Whitehouse | B61D 5/00 | 105/358 |
| 8,689,994 | B2 * | 4/2014 | Pashcow | F16K 31/18 | 116/109 |
| 2007/0007231 | A1 * | 1/2007 | Naesje | B65D 47/2081 | 215/311 |
| 2011/0056938 | A1 * | 3/2011 | Petrarca | B65D 90/34 | 220/203.01 |

* cited by examiner

AUTOMATIC AERATION DEVICE FOR OIL TANK

BACKGROUND OF THE INVENTION

1. Field of the Invention

The present invention relates to an aeration device and, more particularly, to an aeration device for an oil tank that is used in a gas station.

2. Description of the Related Art

The oil tank of a gas station is usually mounted underground and has a determined sealing effect. However, when the oil is infused into or drawn from the oil tank, it is necessary to produce an air convection between the oil tank and the ambient environment, so that the oil can be infused into or drawn from the oil tank conveniently. Thus, the oil tank needs to have an aeration device. A conventional aeration device with a vacuum breaking function in accordance with the prior art shown in FIGS. 6 and 7 comprises a floating roof (A) mounted in an oil tank 4, a seat (B) mounted on the floating roof (A) and having a central hole (B2) which has a periphery provided with a plurality of vent holes (B1), a support post (C) extending through the central hole (B2) of the seat (B), and a cover plate (D) secured on an upper end of the support post (C). When the oil is infused into or drawn from the oil tank 4, the floating roof (A) is moved upward or downward by the buoyancy of the oil. When the lower end of the support post (C) touches the bottom of the oil tank 4, the cover plate (D) is pushed upward by the support post (C) to connect the vent holes (B1) to the ambient environment so as to provide an aerating effect. However, the support post (C) has a determined weight so that it is difficult to open the cover plate (D). Thus, the conventional aeration device does not have a pressure regulation function. In addition, when the lower end of the support post (C) hits the bottom of the oil tank 4, the cover plate (D) is easily broken when the support post (C) is inclined.

BRIEF SUMMARY OF THE INVENTION

The primary objective of the present invention is to provide an automatic aeration device for an oil tank of a gas station.

In accordance with the present invention, there is provided an automatic aeration device comprising a first floating roof, a second floating roof and a movable valve. The first floating roof has a through hole which has a periphery provided with a first enclosure extending upward vertically through a first height. The first enclosure has an upper end provided with a first upper flange. The second floating roof has a maximum area smaller than an area of the through hole of the first floating roof The second floating roof has an upper face provided with a second enclosure extending upward vertically through a second height that is greater than the first height of the first enclosure. The second enclosure has an upper end provided with a second upper flange. The movable valve has a plate provided with a central hole which extends vertically through the plate. The plate has a lower portion provided with an outer wall and an inner wall arranged concentrically. The outer wall and the inner wall extend downward vertically through a determined depth. The outer wall has an outer diameter smaller than an inner diameter of the first enclosure and has a lower end provided with a first lower flange interfering with the first upper flange. The inner wall has an outer diameter smaller than an inner diameter of the second enclosure and has a lower end provided with a second lower flange interfering with the second upper flange. The outer wall has an upper end provided with a plurality of first vent holes. The inner wall has an upper end provided with a plurality of second vent holes. The movable valve is mounted on and covers an upper portion of the through hole of the first floating roof, with the outer wall being mounted in the first enclosure of the first floating roof, and with the inner wall being mounted in the second enclosure of the second floating roof.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
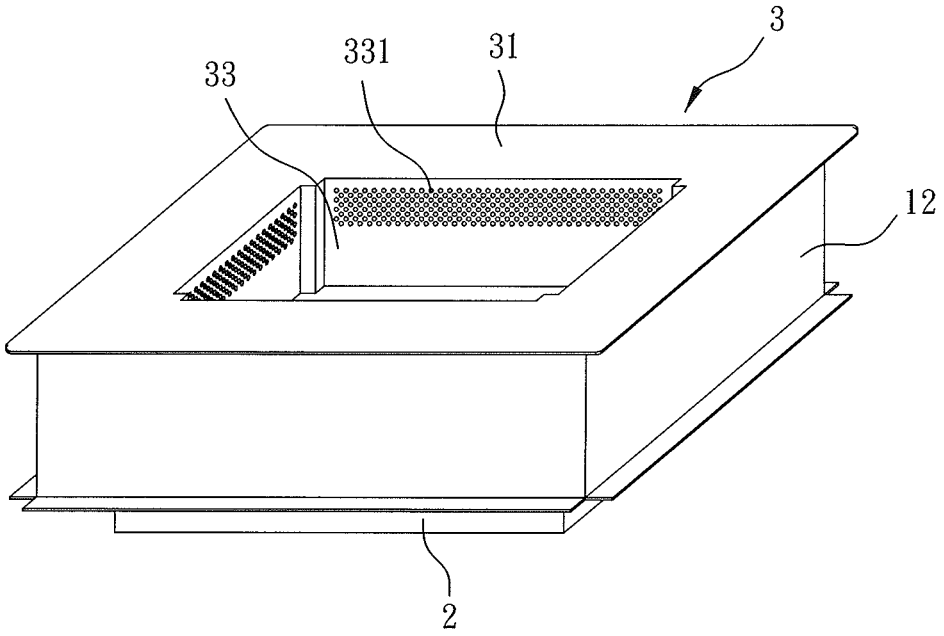
FIG. 1 is a perspective view of an automatic aeration device in accordance with the preferred embodiment of the present invention.
Figure 2:
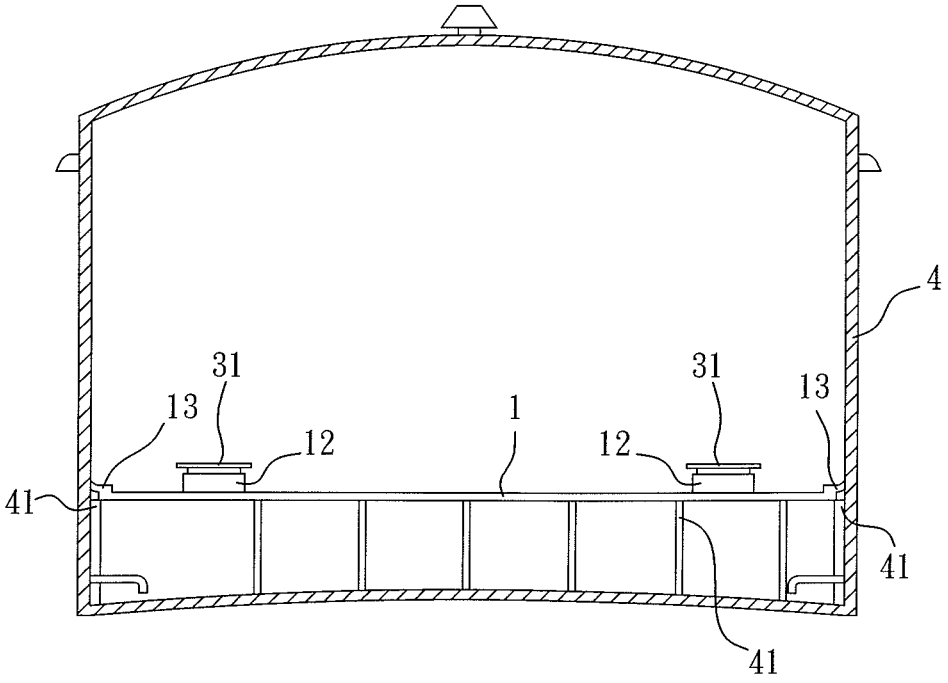
FIG. 2 is a cross-sectional assembly view showing the automatic aeration device being mounted in an oil tank.
Figure 3:
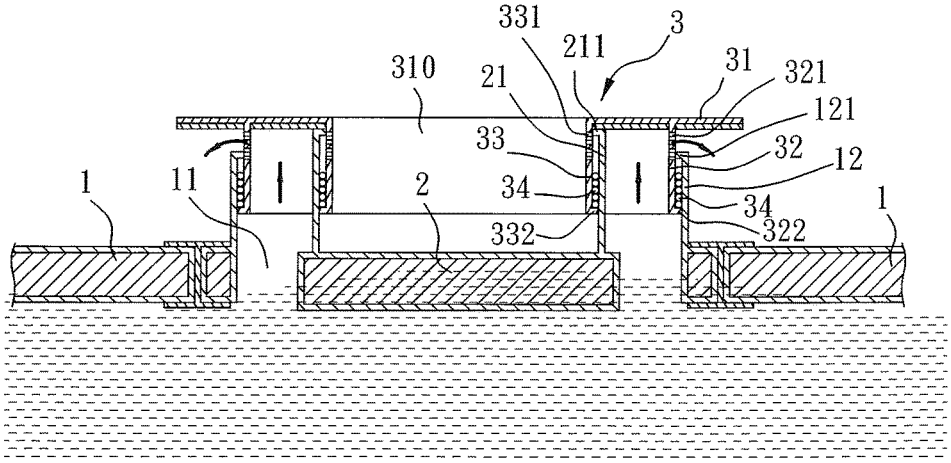
FIG. 3 is a cross-sectional operational view showing that the air is drained outward when the oil is infused into the oil tank.

Referring to the drawings and initially to FIGS. 1-3, an automatic aeration device in accordance with the preferred embodiment of the present invention comprises a first floating roof 1, a second floating roof 2 and a movable valve 3.

The automatic aeration device is mounted in an oil tank 4 to regulate automatically the air inlet and outlet and the pressure balance of the oil tank 4. The oil tank 4 contains oil therein and has a lower portion provided with a plurality of stop portions 41 having determined height.

The first floating roof 1 floats on the oil level of the oil tank 4. The first floating roof 1 has an outer diameter slightly smaller than the inner diameter of the oil tank 4. A sealing ring 13 is mounted on the outer diameter of the first floating roof 1 and slidably rests on the inner wall of the oil tank 4 so that the first floating roof 1 is moved upward and downward in the oil tank 4 and has a sealing effect. The sealing ring 13 is made of rubber. The first floating roof 1 has a center provided with a through hole 11 which has a periphery provided with a first enclosure 12 extending upward vertically through a first height. The first enclosure 12 has an upper end provided with a first upper flange 121.

The second floating roof 2 floats on the oil level of the oil tank 4. The second floating roof 2 has a maximum area smaller than an area of the through hole 11 of the first floating roof 1. The second floating roof 2 has an outer diameter smaller than the inner diameter of the through hole 11 of the first floating roof 1. The second floating roof 2 has an upper face provided with a second enclosure 21 extending upward vertically through a second height that is greater than the first height of the first enclosure 12. The second enclosure 21 has an upper end provided with a second upper flange 211.

The movable valve 3 has a plate 31 provided with a central hole 310 which extends vertically through the plate 31. The plate 31 has a lower portion provided with an outer wall 32 and an inner wall 33 arranged concentrically. The outer wall 32 and the inner wall 33 extend downward vertically through a determined depth. Preferably, the outer wall 32 and the inner wall 33 extend downward through the same depth. The outer wall 32 has an outer diameter smaller than an inner diameter of the first enclosure 12 and has a lower end provided with a first lower flange 322 interfering with the first upper flange 121. The inner wall 33 has an outer diameter smaller than an inner diameter of the second enclosure 21 and has a lower end provided with a second lower flange 332 interfering with the second upper flange 211. The outer wall 32 has an upper end provided with a plurality of first vent holes 321. The inner wall 33 has an upper end provided with a plurality of second vent holes 331. The movable valve 3 is mounted on and covers an upper portion of the through hole 11 of the first floating roof 1, with the outer wall 32 being mounted in the first enclosure 12 of the first floating roof 1, and with the inner wall 33 being mounted in the second enclosure 21 of the second floating roof 2.

In the preferred embodiment of the present invention, the first upper flange 121 extends horizontally in a direction of the inner diameter of the first enclosure 12, and the first lower flange 322 extends horizontally in a direction of the outer diameter of the outer wall 32.

In the preferred embodiment of the present invention, the second upper flange 211 extends horizontally in a direction of the inner diameter of the second enclosure 21, and the second lower flange 332 extends horizontally in a direction of the outer diameter of the inner wall 33.

In the preferred embodiment of the present invention, the automatic aeration device further comprises a plurality of balls 34 mounted between the inner diameter of the first enclosure 12 and the outer diameter of the outer wall 32, and mounted between the inner diameter of the second enclosure 21 and the outer diameter of the inner wall 33.

As shown in FIGS. 2 and 3, the automatic aeration device is mounted in the oil tank 4, with the first floating roof 1 and the second floating roof 2 being supported by the buoyancy of the oil contained in the oil tank 4. In such a manner, when the oil is fed into the oil tank 4, the second floating roof 2 is pushed upward by the oil, and the second enclosure 21 is moved upward to push the plate 31 of the movable valve 3 upward by the second upper flange 211 of the second enclosure 21, so that the first vent holes 321 of the outer wall 32 are opened, and the second vent holes 331 of the inner wall 33 are closed as shown in FIG. 3. Thus, the air in the oil tank 4 is forced by the oil to pass through the first vent holes 321 of the outer wall 32 and is drained outward from the first vent holes 321 of the outer wall 32 into the ambient environment as indicated by the arrows in FIG. 3.

Figure 4:
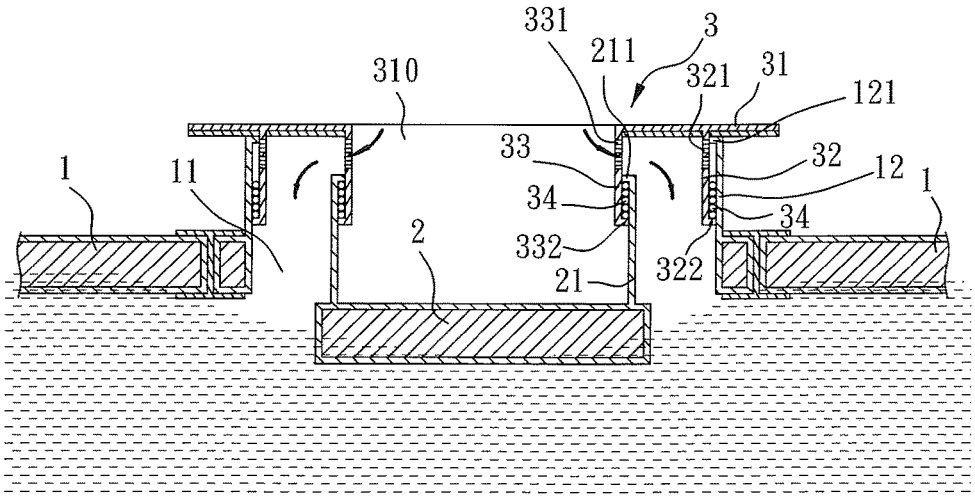
FIG. 4 is a cross-sectional operational view showing that the air is introduced into the oil tank when the oil is drawn from the oil tank.

As shown in FIG. 4, when the oil is drawn outward from the oil tank 4, the second floating roof 2 is moved downward to lower the second enclosure 21, so that the second upper flange 211 of the second enclosure 21 is moved downward to push the balls 34 and the second lower flange 332 of the inner wall 33. In such a manner, the inner wall 33 is moved downward to pull the plate 31 of the movable valve 3 downward, so that the first vent holes 321 of the outer wall 32 are closed, and the second vent holes 331 of the inner wall 33 are opened. Thus, the ambient air in introduced through the second vent holes 331 of the inner wall 33 into the oil tank 4 as indicated by the arrows.

Figure 5:
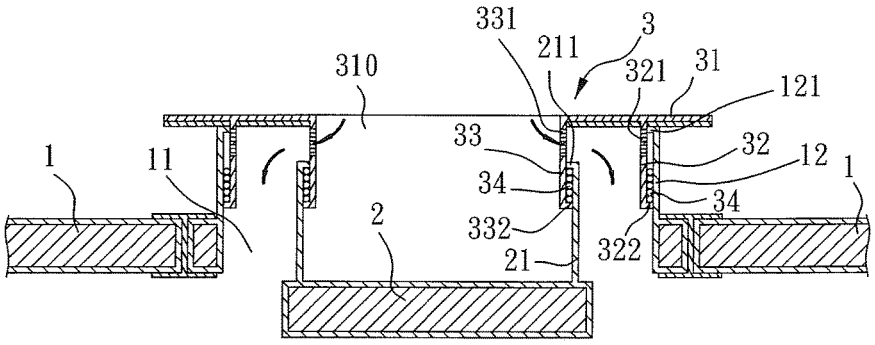
FIG. 5 is a cross-sectional operational view showing that the oil is drawn completely outward from the oil tank for maintenance of the oil tank.
Figure 6:
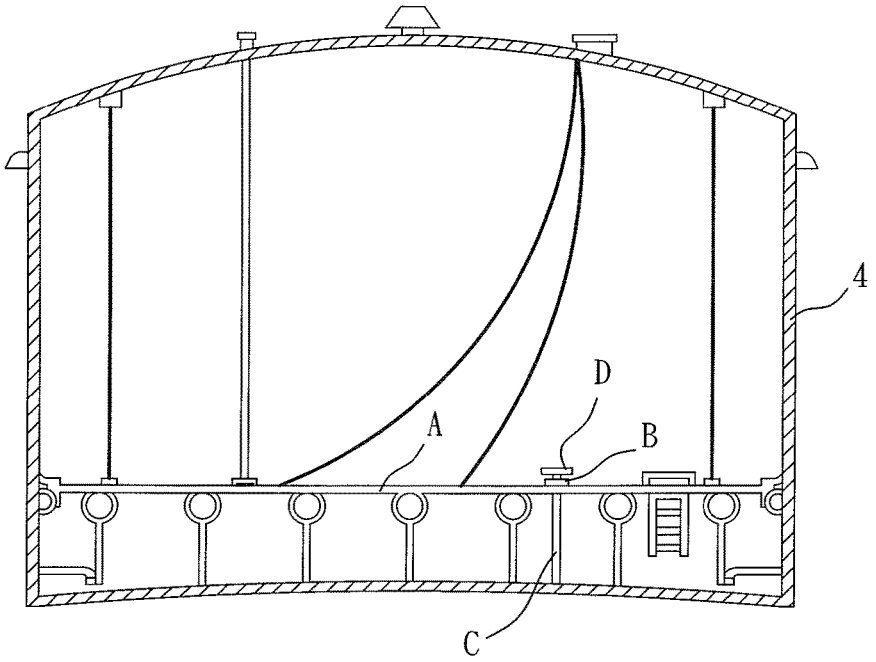
FIG. 6 PRIOR ART
FIG. 6 is a cross-sectional view of a conventional aeration device with a vacuum breaking function in accordance with the prior art.
Figure 7:
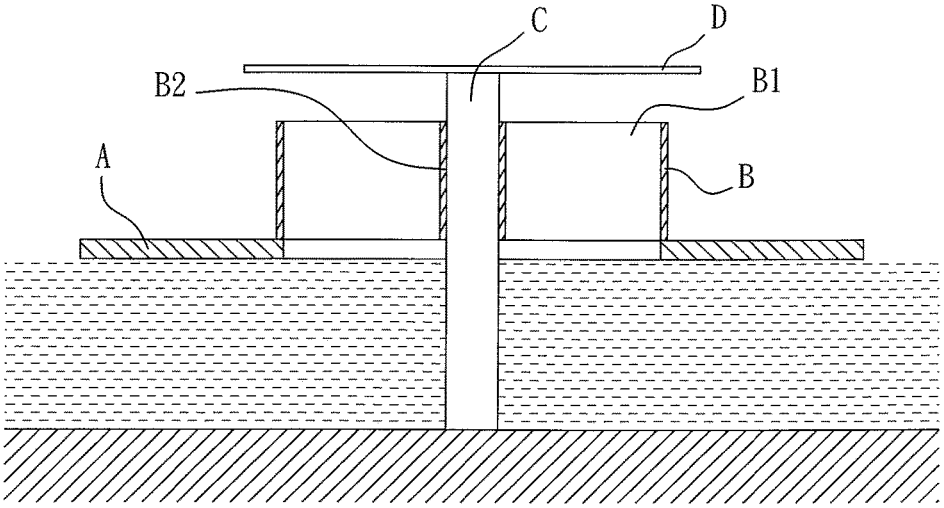
FIG. 7 PRIOR ART
FIG. 7 is a cross-sectional view showing operation of the conventional aeration device in accordance with the prior art.

As shown in FIG. 5 with reference to FIG. 2, when the oil is drawn completely outward from the oil tank 4 for maintenance of the oil tank 4, the first floating roof 1 and the second floating roof 2 are moved downward by the gravity until the first floating roof 1 are stopped by the stop portions 41. At this time, the second upper flange 211 of the second enclosure 21 is moved downward to push the balls 34 and the second lower flange 332 of the inner wall 33, and the inner wall 33 is moved downward to pull the plate 31 of the movable valve 3 downward, so that the first vent holes 321 of the outer wall 32 are closed, and the second vent holes 331 of the inner wall 33 are opened. Thus, the ambient air in introduced through the second vent holes 331 of the inner wall 33 into the oil tank 4 as indicated by the arrows, so as to ventilate the oil tank 4.

It is appreciated that, when the second floating roof 2 and the movable valve 3 are moved upward and downward, the balls 34 provide a rolling effect between the first enclosure 12 and the outer wall 32, and between the second enclosure 21 and the inner wall 33, to reduce the friction, thereby facilitating opening and closing of the movable valve 3.

Accordingly, the automatic aeration device regulates automatically the interior pressure and the air convection of the oil tank 4, so that the oil is infused into or drawn from the oil tank 4 conveniently, without incurring a mechanically breaking problem. In addition, after the automatic aeration device is mounted in the oil tank 4, the automatic aeration device maintains the pressure balance of the oil tank 4 automatically at any moment. Further, when the oil is infused into or drawn from the oil tank 4, the automatic aeration device keeps the air convection between the oil tank 4 and the ambient environment, so that the oil is infused into or drawn from the oil tank 4 smoothly. Further, the automatic aeration device has a structure that prevents a mechanical breaking.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An automatic aeration device comprising:

a first floating roof, a second floating roof and a movable valve;

wherein:

the first floating roof has a through hole which has a periphery provided with a first enclosure extending upward vertically through a first height;

the first enclosure has an upper end provided with a first upper flange;

the second floating roof has a maximum area smaller than an area of the through hole of the first floating roof;

the second floating roof has an upper face provided with a second enclosure extending upward vertically through a second height that is greater than the first height of the first enclosure;

the second enclosure has an upper end provided with a second upper flange;

the movable valve has a plate provided with a central hole which extends vertically through the plate;

the plate has a lower portion provided with an outer wall and an inner wall arranged concentrically;

the outer wall and the inner wall extend downward vertically through a determined depth;

the outer wall has an outer diameter smaller than an inner diameter of the first enclosure and has a lower end provided with a first lower flange interfering with the first upper flange;

the inner wall has an outer diameter smaller than an inner diameter of the second enclosure and has a lower end provided with a second lower flange interfering with the second upper flange;

the outer wall has an upper end provided with a plurality of first vent holes;

the inner wall has an upper end provided with a plurality of second vent holes; and the movable valve is mounted on and covers an upper portion of the through hole of the first floating roof, with the outer wall being mounted in the first enclosure of the first floating roof, and with the inner wall being mounted in the second enclosure of the second floating roof.

2. The automatic aeration device of claim 1, wherein the first upper flange extends horizontally in a direction of the inner diameter of the first enclosure, and the first lower flange extends horizontally in a direction of the outer diameter of the outer wall.

3. The automatic aeration device of claim 2, wherein the second upper flange extends horizontally in a direction of the inner diameter of the second enclosure, and the second lower flange extends horizontally in a direction of the outer diameter of the inner wall.

4. The automatic aeration device of claim 3, further comprising:

a plurality of balls mounted between the inner diameter of the first enclosure and the outer diameter of the outer wall, and mounted between the inner diameter of the second enclosure and the outer diameter of the inner wall.

* * * * *